US005507368A

United States Patent [19]

Barefoot

[11] Patent Number: 5,507,368

[45] Date of Patent: Apr. 16, 1996

[54] RAILWAY CAR TRUCK MOUNTED BRAKE ASSEMBLY WITH MULTIPLE PISTON AIR CYLINDER

[75] Inventor: Richard Barefoot, Greenville, S.C.

[73] Assignee: Ellcon National, Inc., Greenville, S.C.

[21] Appl. No.: 419,728

[22] Filed: Apr. 10, 1995

[51] Int. Cl.[6] ..... B60T 11/10

[52] U.S. Cl. ..... 188/52; 188/153 R; 188/198

[58] Field of Search ..... 188/52–55, 46, 188/47, 33, 107, 106 R, 106 P, 72.6, 72.5, 198, 203, 204 R, 153 R, 153 D, 153 A

[56] References Cited

U.S. PATENT DOCUMENTS

| | | | |
|---|---|---|---|
| 371,602 | 10/1887 | Lawrence | 188/153 R |
| 598,766 | 2/1898 | Campany | 188/153 D |
| 2,274,859 | 3/1942 | Eksergian | 188/59 |
| 3,027,976 | 4/1962 | Soddy | 188/59 |
| 3,301,353 | 1/1967 | Goods | 188/153 R |
| 3,780,837 | 12/1973 | Haydu | 188/52 X |
| 4,060,152 | 11/1977 | Bogenschutz et al. | 188/52 |

*Primary Examiner*—Douglas C. Butler

*Attorney, Agent, or Firm*—Brooks Haidt Haffner & Delahunty

[57] ABSTRACT

Braking apparatus for a vehicle having a plurality of wheels and brake shoes engageable with the wheels which apparatus includes a cylinder and piston assembly including at least two pistons movable in opposite directions by fluid under pressure supplied intermediate the pistons and at least one fixed partition between the pistons. The pistons are connected to the brake shoes at opposite ends of the cylinder and piston assembly by piston rods and levers. When the vehicle has a bolster and two pairs of wheels, the cylinder and piston assembly, which is movable with respect to the bolster, and one pair of wheels are at one side of the bolster and the other pair of wheels is at the other side of the bolster, the brake shoes for the latter wheels being connected to the levers by slack adjusters.

21 Claims, 7 Drawing Sheets

1
2
15
50
48
59
58
50
15
13
48
7
9
79
57
43
36
37
55
53
41
73a
46
75a
35
45
46
65
21
70
24
23
3
19
27
31
66
72
30
69
3
68
67
16
30a
31a
63
27a
18
71
22
24a
6
20
46
45
64
42
40
75
35a
73
38
54
39
55
14
12
8
79a
60
10
62
61
48
48
15
50
50
15
2

RAILWAY CAR TRUCK MOUNTED BRAKE ASSEMBLY WITH MULTIPLE PISTON AIR CYLINDER

FIELD OF THE INVENTION

The invention relates to brake actuation apparatus, primarily for railway cars, in which the brake rigging is operated by a piston in an air cylinder.

BACKGROUND OF THE INVENTION

Railway car braking apparatus in which one or more air operable piston and cylinder assemblies, each cylinder containing one piston, is supported from the car truck and which, when supplied with air at above atmospheric pressure, applies forces to the brake rigging and to the brake shoes engageable with the four wheels supporting the truck which supports the car body is known. See, for example, U.S. Pat. Nos. 3,107,754 and 4,312,428.

Some of the prior art systems require mounting of the piston and cylinder assembly or assemblies on the truck bolster which increases the installation time, labor and cost. To obtain the braking forces required, a cylinder of relatively large diameter is used and the available space for location of such a cylinder is relatively limited. Also, some prior art systems require openings in the truck bolster for the passage of components of the system, and because different trucks, built by different builders, may not have openings in the bolster of the proper size or location for the passage of such components, either the prior art systems cannot be installed on some of such trucks or a new opening or openings must be provided in the bolster which is undesirable.

In addition, in prior art systems, the slack adjuster, i.e. the device which is used to limit piston stroke with brake shoe wear, usually is located in the braking assembly so that it measures piston stroke which addresses only brake force losses due to piston stroke length and the accompanying air pressure drop in the cylinder but does not address the problem of the loss of force at the brake shoes due to a change in direction of a lever or a bell crank angularity. If the mechanisms downstream of where the slack adjuster measures piston stroke length is "fouled", the slack adjuster may properly compensate for piston stroke change but may result in insufficient or no braking force on the shoes.

Furthermore, prior art braking systems usually require a relatively large and strong brake shoe beam which transmits the force of the piston to shoes engageable with two different pairs of truck wheels. Such beams are relatively expensive and occupy a large part of the space available on the truck for braking apparatus.

BRIEF SUMMARY OF THE INVENTION

One object of the invention is to simplify truck mounted braking apparatus.

Another object of the invention is to reduce the cost and labor required for installing truck mounted braking apparatus.

Another object of the invention is to eliminate the conventional brake beams.

Another object of the invention is to dispose brake slack adjusters where they directly measure shoe wear rather than piston stroke length.

Another object of the invention is to provide a piston and cylinder assembly with a cylinder of smaller diameter than prior art cylinders and which can be readily modified with minor changes to meet different brake force requirements.

Another object of the invention is to provide, optionally, a cylinder which is part of the brake mechanism and which can be used to replace the conventional air reservoir.

In accordance with the preferred embodiment of the invention, an air cylinder which is of relatively small diameter and of a length longer than a conventional cylinder and contains at least two pistons, and preferably, at least four pistons, is provided at one side of a truck bolster with its axis substantially parallel to the axes of the axles of the truck wheels. When air under pressure is supplied to the cylinder one-half of the number of pistons moves in one direction and the other half of the number of pistons moves in the opposite direction. The piston or pistons which move in one direction are connected to a first piston rod and the piston or pistons which move in the opposite direction are connected to a second piston rod.

The first piston rod is pivotally connected to levers at one end of the bolster, one of which levers is connected to a first brake shoe head with a brake shoe for one wheel at such end of the bolster for moving such brake shoe into engagement with such one wheel and the other of which is pivotally connected to one end of a first slack adjuster which passes under the bolster to a brake shoe head with a second brake shoe for the other wheel at such end of the bolster for moving the latter brake shoe into engagement with the other wheel.

The second piston rod is similarly connected to a third brake shoe head with a brake shoe for a wheel at the other end of the bolster and to a second slack adjuster which similarly passes beneath the bolster and is connected to a brake shoe head with a fourth brake shoe which is engageable with the other wheel at such other end of the bolster.

The brake shoe heads for the second and fourth brake shoes are interconnected by a tube, similar to the air cylinder and which can be an air reservoir.

BRIEF DESCRIPTION OF THE DRAWINGS

Other objects and advantages of the present invention will be apparent from the following detailed description of the presently preferred embodiments thereof, which description should be considered in conjunction with the accompanying drawings in which.

Figure 1:
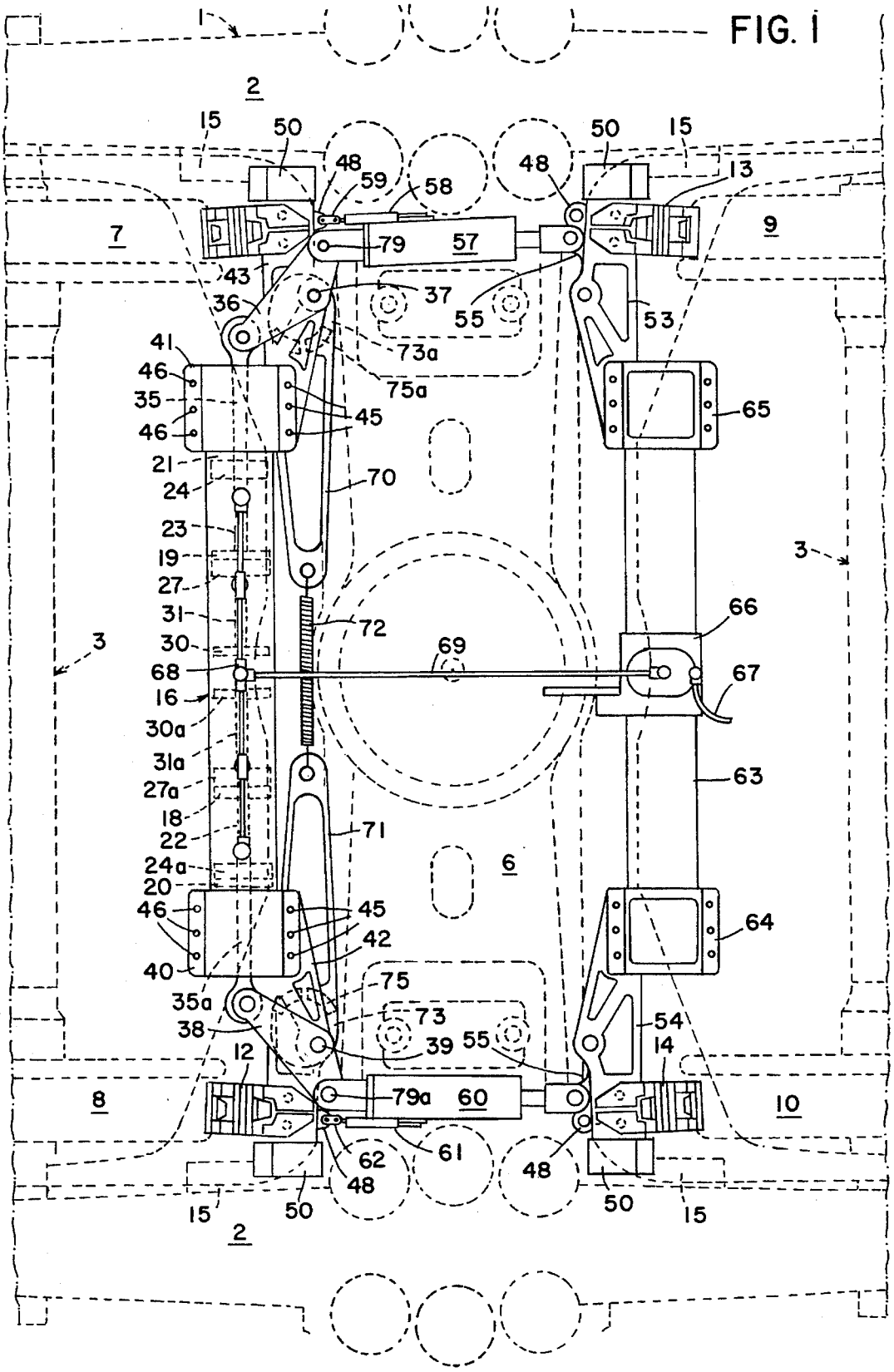
FIG. 1 is a plan view, with conventional truck parts shown in dashed lines, of the preferred embodiment of the invention with the brakes in their released position.

For purposes of illustration, it will be assumed that the car truck has the structure shown in U.S. Pat. No. 3,107,754 which is shown in dashed lines in the drawing. However, it will be apparent that the car truck can have other structures, and the braking apparatus of the invention is shown in solid lines except to the extent that parts hidden by other parts are necessarily illustrated by dashed lines.

Figure 5:
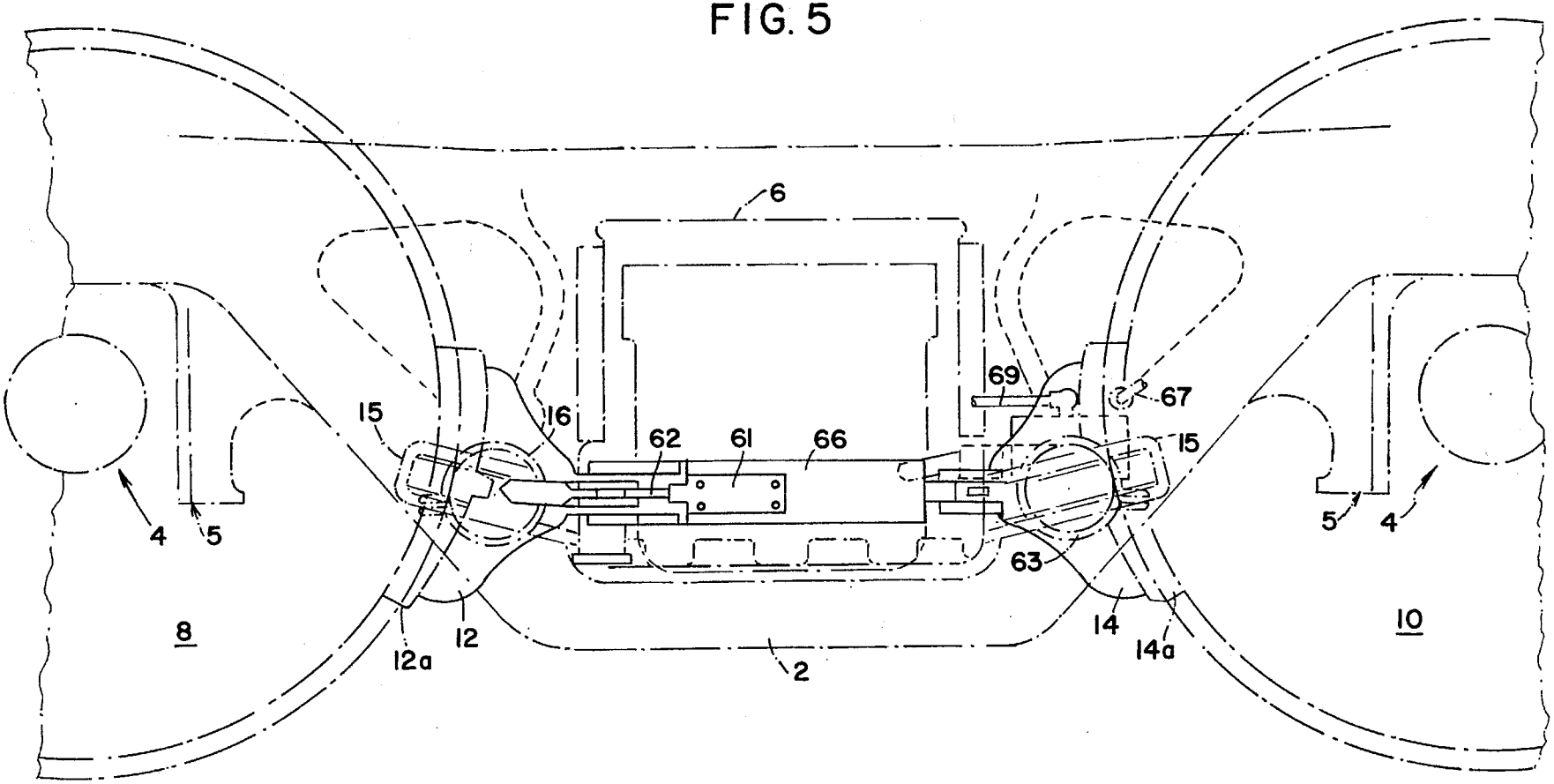
FIG. 5 is an end elevation view of the preferred embodiment of the invention.

In the drawings, a railway car truck 1 which supports the car body (not shown) at one end, there being a similar car body truck supporting the car body at its opposite end, comprises two side frames 2 supported at their ends upon wheel and axle asssemblies 3 journaled in journal boxes 4 (FIG. 5) engaged between pedestal jaws 5. The bolster and its connection to the side frames 2 are described in detail in said U.S. Pat. No. 3,107,754.

At a first end of the bolster 6 and at a first side thereof, there is a first wheel 7, and at the second, opposite end of the bolster 6 and at the first side thereof, there is a second wheel 8. At the second, opposite side of the bolster 6, there is a third wheel 9 at said first end of the bolster 6 and there is a fourth wheel 10 at said second end and said second side of said bolster 6. Brake shoe heads 11, 12, 13 and 14 are, respectively, adjacent the wheels 7, 8, 9 and 10 for braking of the vehicle. Each of the brake shoe heads 11–14 has a brake shoe, such as the shoes 12*a* and 14*a* (FIG. 5) engageable with the adjacent wheel.

Each side frame 2, on its inboard side, has guide members 15 providing slots therebetween inclined upwardly toward the axes of the respective wheel and axle assemblies 3 as described in said U.S. Pat. No. 3,107,754, the use of which will be described hereinafter.

Intermediate the first and second ends and at the first side of the bolster 6, there is a fluid actuable cylinder and piston assembly 16. The cylinder 17 contains at least two pistons and preferably, for reasons set forth hereinafter, contains at least six pistons 18, 19, 20, 21, 30 and 30*a*. The pistons 18, 20 and 30*a* are rigidly interconnected by rods 22 and 31*a* and the pistons 19, 21 and 30 are rigidly interconnected by rods 23 and 31 whereby the pistons 18, 20 and 30*a* move in unison and the pistons 19, 21 and 30 move in unison.

Figure 3:
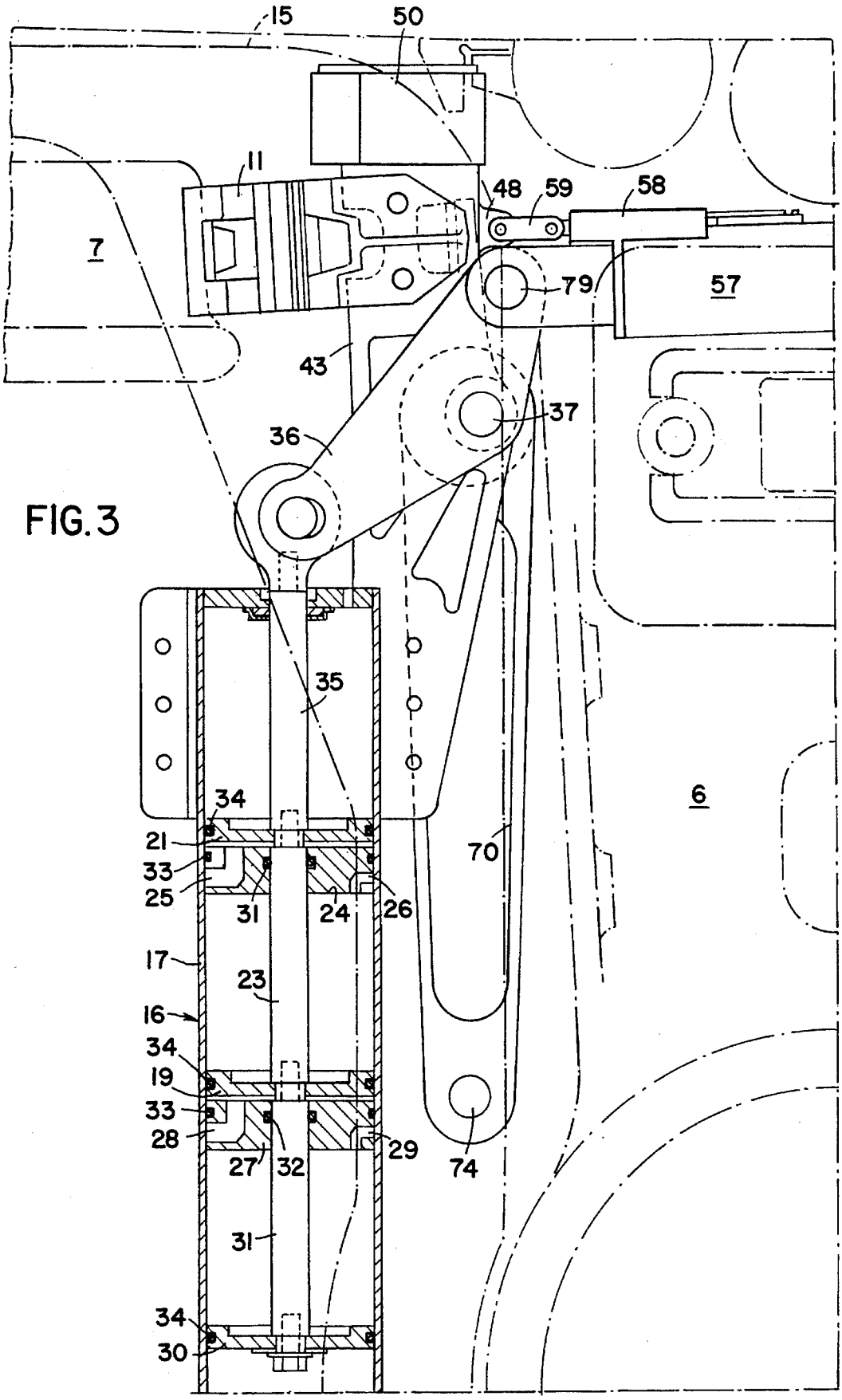
FIG. 3 is an enlarged, fragmentary plan view of parts shown in FIGS. 1 and 2.

For a better understanding of the cylinder and piston assembly 16, reference will be made to FIG. 3 which illustrates one-half of the assembly 16, the other half of the assembly 16 being of similar construction. FIG. 3 shows the pistons 19 and 21 interconnected by the rigid rod 23. Between the piston 21 and the piston 19 there is a partition or bulkhead 24, fixed in position relative to the cylinder 17, having an inlet port 25 for the admission of fluid, e.g. air, at a pressure above atmospheric pressure and an outlet port 26 for exhausting fluid between the partition 24 and the piston 19 to the atmosphere.

A second partition 27, fixed in position relative to the cylinder 17, is adjacent the piston 19 and has an inlet port 28, similar to the inlet port 25, and an outlet port 29. The cylinder 17 also contains a guide piston 30 rigidly connected to the piston 19 by a rigid rod 31. The partitions 24 and 29 are provided with conventional fluid seals 32 and 33 and the pistons 19, 21 and 30 are provided with conventional fluid seals 34.

A first piston rod 35 is connected to the piston 21 and is pivotally connected to first lever means including a first lever, or bell crank 36 pivotable around a pin 37. Thus, when fluid under pressure above atmospheric pressure is supplied to the inlet ports 25 and 28 and between the pistons 30 and 30*a*, the pistons 19, 21 and 30 and the piston rod 35 move upwardly as viewed in FIG. 3, and hence, outwardly from the cylinder 17 and toward said first end of said bolster 6 and toward said shoe head 11.

As mentioned, the other half of the cylinder and piston assembly is the same in construction on the half thereof described hereinbefore and has fixed partitions 24*a* and 27*a*, pistons 18, 20 and 30*a* and rods 22 and 31*a* (see FIG. 1). It also has a second piston rod 35*a* which is pivotally connected to a second lever means including a lever, or bell crank, 38 pivotable about a pin 39.

The axes of the axles of the wheel and axle assemblies 3 extend transversely to the length of a railway car, and it will be noted that the length of the bolster 6, the length of the cylinder 17 and the axes of the piston rods 35 and 35*a* extend substantially parallel to said axes of said axles. Due to the multiple pistons 18–21, 30 and 30*a*, the cylinder 17 can be relatively long and of a relatively small diameter compared to prior art cylinder and piston asssemblies, and therefore, can be disposed substantially parallel to the axes of the axles of the wheel and axle assemblies 3 whereas it would be difficult, if not impossible, to dispose the cylinder 17 so that its length, or axis, extends perpendicularly to said axes.

The cylinder 17 can be of a small diameter because of the presence of multiple pistons. Thus, the braking force applied to the brake shoes depends upon the face area of a piston or pistons and the fluid pressure applied thereto. Accordingly, for a predetermined amount of braking force and the same fluid pressure, multiple pistons can have a smaller diameter than a single piston as in the prior art, and therefore, the cylinder 17 can have a diameter smaller than a cylinder with a single piston therein. Multiple pistons have further advantages as will be described hereinafter.

A pair of collars 40 and 41 are clamped onto the ends of the cylinder 17 and are secured, in any conventional manner to end extension members 42 and 43. Both end extension members 42 and 43 are the same and are similar to end extension members 53 and 54 hereinafter described, and all can be made from the same casting. However, members 42 and 43 differ slightly from the members 53 and 54. The extension member illustrated in FIGS. 6 and 7 will be designated by the reference numeral 42, and the modifications thereof to form the members 42 and 43 will be described on connection with FIGS. 6 and 7.

The extension member 42 has bolt receiving holes for receiving bolts (not shown) and which match the bolt holes 45 in the collars 41 and 42 through which bolts which clamp the collars 41 and 42 to the cylinder are passed. For other clamping bolts, the collars 41 and 42 also have the holes 46 through which clamping bolts are passed.

The extension member 42 also has a hole 47 for receiving the pin 37 or 39, which can be pins with a head but preferably, are bolts, such as the bolt 39*a* shown in FIG. 11 about which the levers 36 or 38 pivot and has an extension or ear 48 with a hole 49 for receiving a pivot pin for a slack adjuster trigger hereinafter described.

The extension member 42 also has a guide lug 50 which is slidably received in the slot between the guide members 15 on the side frames 2 previously described. Preferably, the lug 50 has a plastic cover, such as a cover 51 made of high density polyethylene, to reduce the friction between the lug 50 and the guide members 15. The brake shoe heads, such as the brake shoe head 12, can be secured to the extension member 42 by bolts (not shown) passing through the holes 52.

Figure 6:
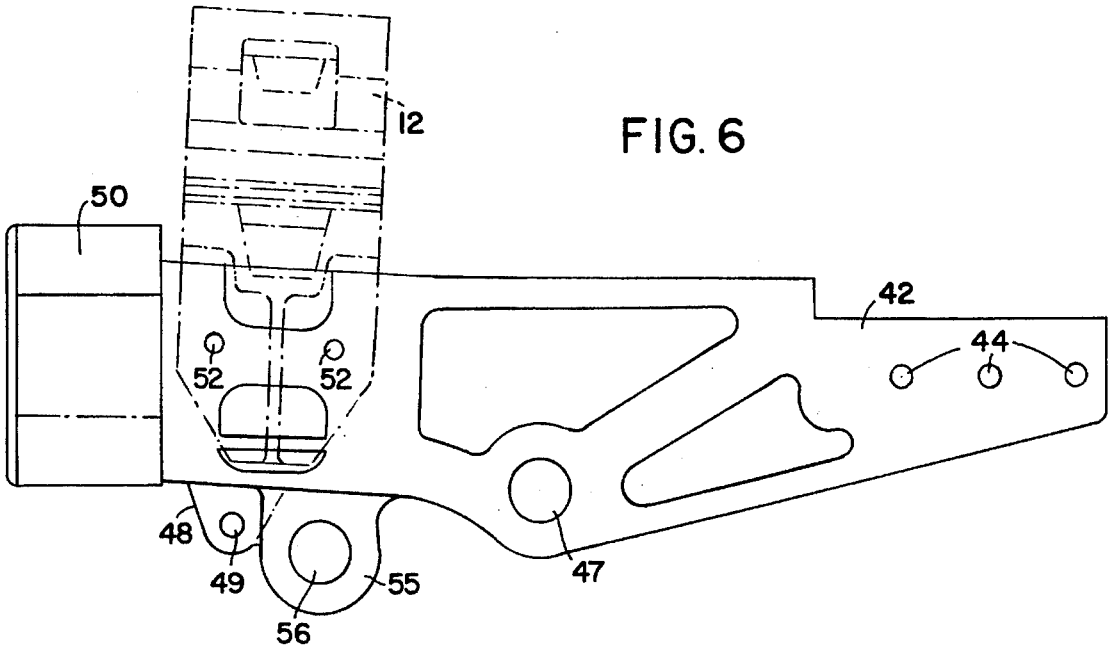
FIGS. 6 and 7 are, respectively, enlarged plan and elevation views of an end portion of parts shown in previous Figs.
Figure 7:
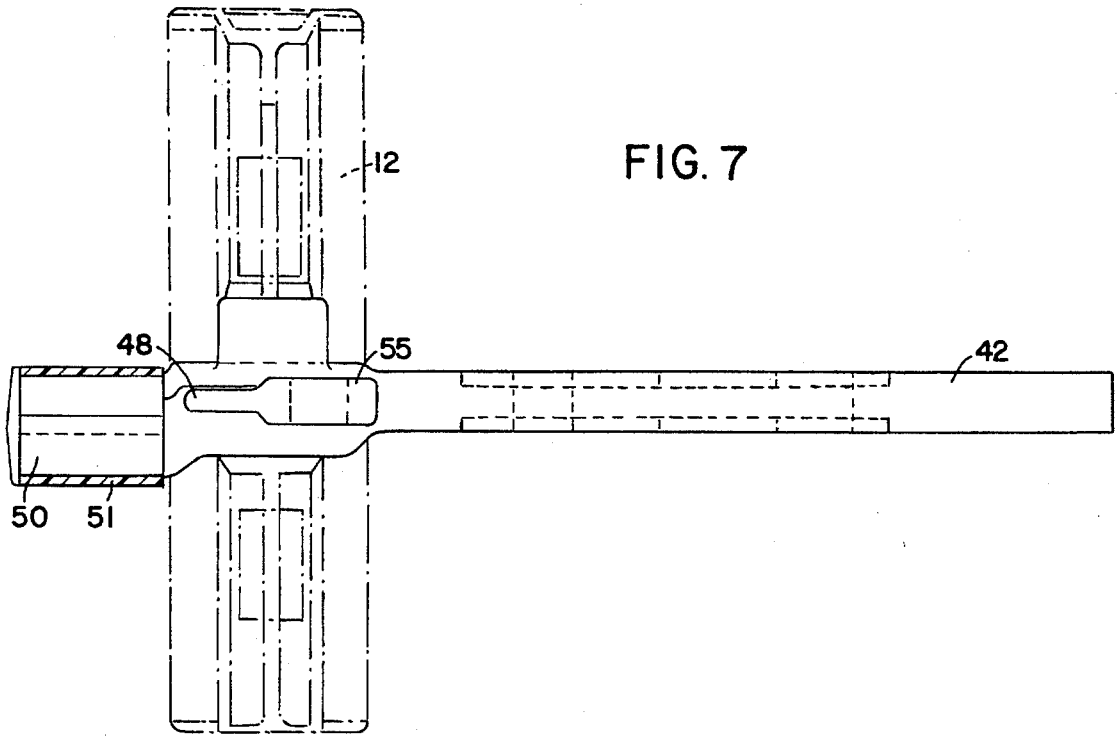
Figure 8:
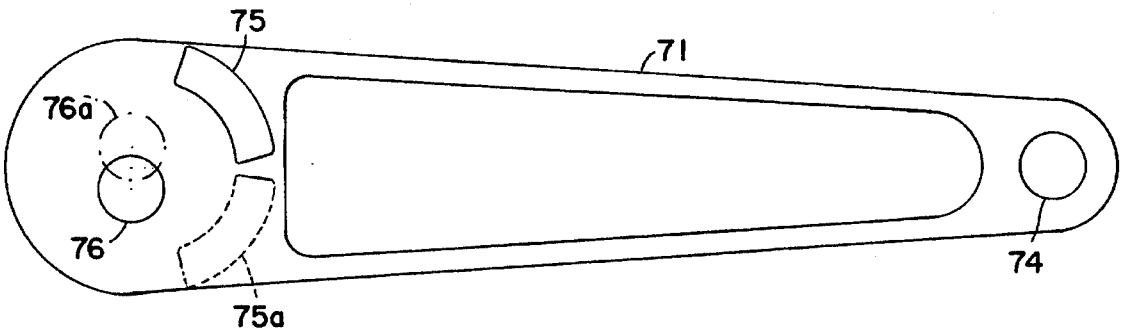
FIG. 8 is an enlarged, top plan view of a lever shown in FIGS. 1 and 2.

While a projection or ear 55 with a hole 56 is shown on the end extension member in FIG. 6, such ear 55 would be removed, such as by machining, when the casting is used for the end extension members 42 and 43 but would be retained when the casting is used for the end extension members 53 and 54. However, when the casting is used for the end extension members 53 and 54, the projection or ear 48 is not required and can remain or can be removed.

The first piston rod 35 pivots the first lever means 36 about the pin 37 and the end of the first lever means 36 remote from the end connected to the rod 35 is pivotally connected to one end of a first conventional slack adjuster 57 having a trigger 58 pivotally coupled to the ear 48 of the end extension member 43 by a link 59. The second lever means 38 similarly interconnects the second piston rod 35*a* with one end of a second conventional slack adjuster 60 having a trigger 61 pivotally coupled by a link 62 to the ear 48 of the end extension member 42.

The opposite end of the first slack adjuster 57 is pivotally connected to the ear 55 of the end extension member 53, and the opposite end of the second slack adjuster 60 is pivotally connected to the ear 55 of the end extension member 54.

Figure 4:
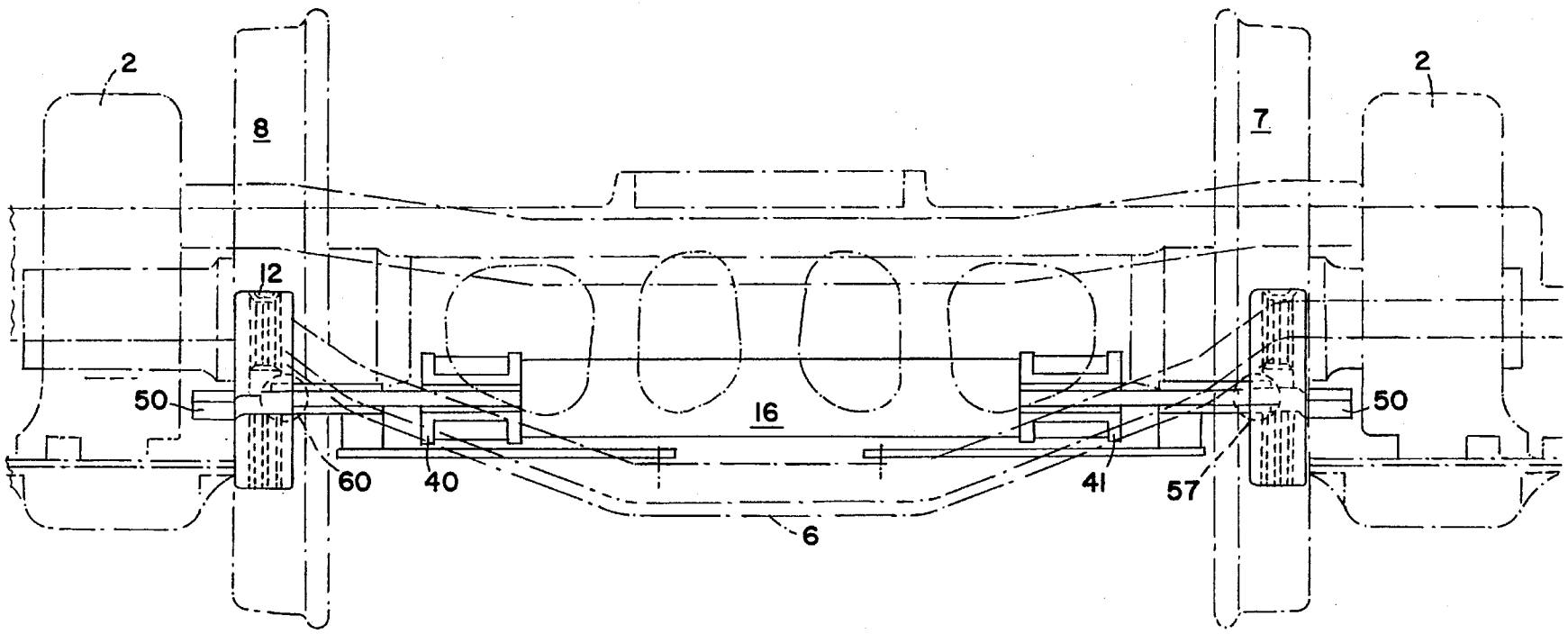
FIG. 4 is an end elevation view of the preferred embodiment of the invention.

From an examination of FIG. 4, it will be observed that the slack adjuster 57 and 60, which are the only parts of the braking apparatus of the invention, other than an optional air line, which pass from one side of the bolster 6 to its other side, pass under the bolster 6, and therefore, holes in the bolster 6 for the passage of parts of the apparatus of the invention are not required. However, it will be apparent that if the bolster 6 has holes of a size and at places which permit the passage of the slack adjusters 57 and 60 in the positions shown, the slack adjusters 57 and 60 can pass through such holes.

Figure 2:
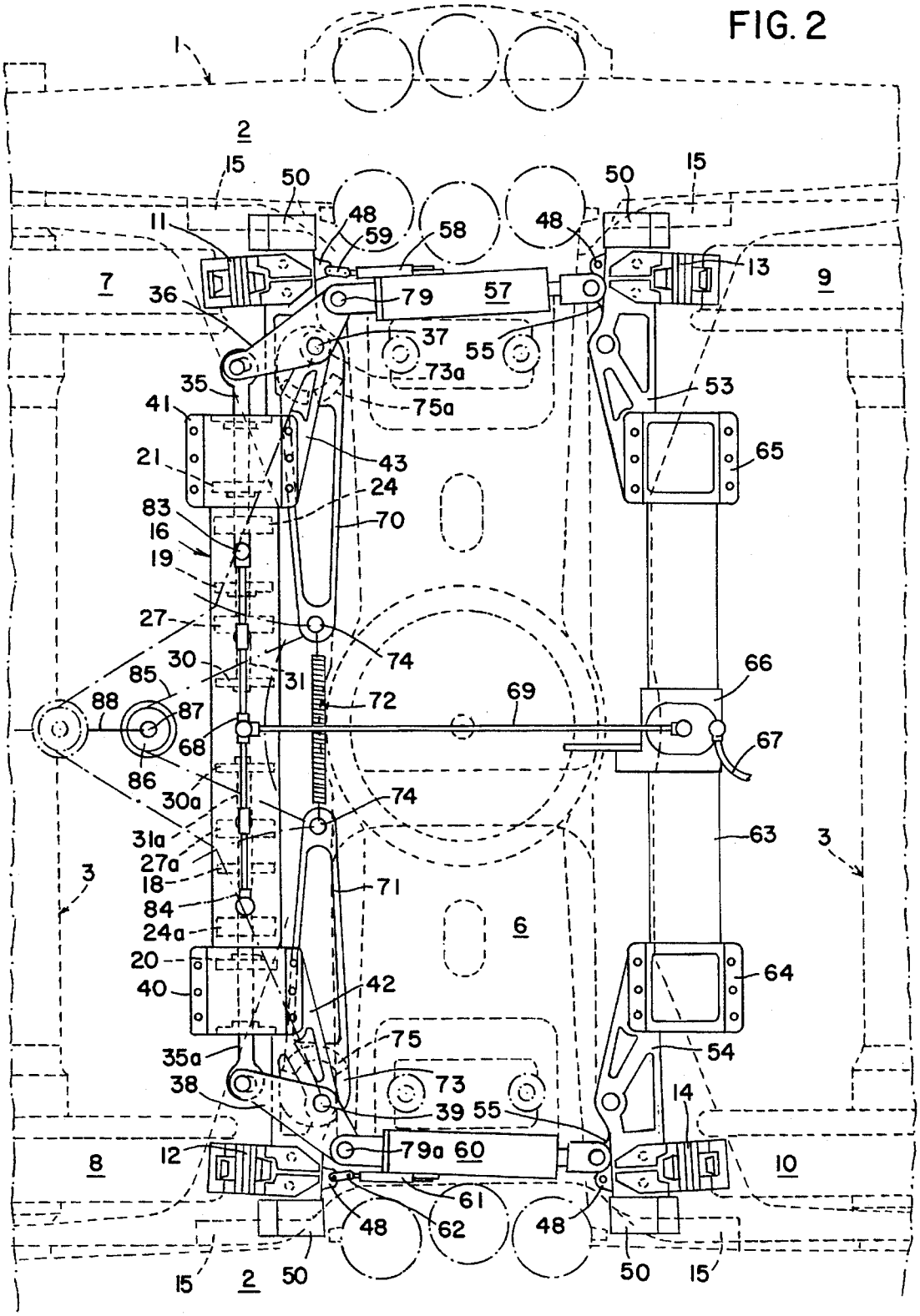
FIG. 2 is similar to FIG. 1 showing the parts in their positions when the brakes are applied.

From an examination of FIGS. 1 and 2, it will be observed that the slack adjusters 57 and 60 are directly connected to the brake shoe heads 11–14 so that they directly measure brake shoe head travel rather than travel of the piston rods 35 and 35*a*.

Although another type of interconnecting means can be employed, preferably, the interconnecting means for the end extension members 53 and 54 comprises a tube 63, like the cylinder 17, and collars 64 and 65, like the collars 40 and 41, not only because the number of different parts can be reduced but also because the tube 63 can serve as an air reservoir, as described hereinafter, thereby eliminating the need for a separate conventional air reservoir. Thus, air tight tube 63 is clamped by the collars 64 and 65 which secure the tube 63 to the end members 53 and 54 in the same manner as the cylinder 17 is secured to the end members 42 and 43.

When the tube 63 is an air reservoir, an air brake valve 66 is mounted on, and secured to, the tube 63 in any desired manner and is supplied with air from the train line by the air line 67. Air from the valve 66 is supplied by the air line 69 from the valve 66 to a manifold 68 connected, for air supply, to the inlet ports 25, 28, etc., of the cylinder 17 and between the pistons 30 and 30*a*. Although the air line 69 is shown as rectilinear, it is relatively small and can be of the shape required to pass above the bolster 6 and between the valve 66 and the manifold 68 without a hole through the bolster 6 or can be passed through an existing hole in the bolster 6.

FIGS. 1 and 3 illustrate the positions of parts of the braking apparatus of the invention in their brake released positions, and FIG. 2 illustrates the positions of such parts when the brakes are applied. From FIGS. 1 and 3, it will be observed that the piston rods 35 and 35*a* are retracted, in which position the brake shoes of the heads 11–14 do not apply braking pressure to the wheels 7–10. When air under pressure is supplied to the inlet ports 25, 28, etc. and between the pistons 30 and 30*a*, by way of the valve 66, air line 69 and manifold 68, the pistons 19, 21 and 30 move the first piston rod 35 toward the shoe head 11, and the pistons 18, 20 and 30*a* move the second piston rod 35*a* toward the shoe head 12. The end of the lever means 36 connected to the end of the first slack adjuster 57 pushes the slack adjuster 57 toward the wheel 9 until the shoe of the shoe head 13 engages the wheel 9 at which time, the opposing force of such engagement of the shoe of the head 13 with the wheel 9 causes the end extension member 43 to move toward the wheel 7 and causes the shoe of the shoe head 11 to engage the wheel 7. Further movement of the rod 35 outwardly of the cylinder 17 increases the braking pressure applied to the wheels 7 and 9.

At the same time that the piston rod 35 moves toward the shoe 11, the piston rod 35*a* moves toward the shoe head 12, and the force of the air pressure on the cylinder 17 when the rod 35 moves and tending to move the cylinder 17 toward the shoe head 12 is at least partially, and normally, substantially, opposed by the force of the air pressure on the cylinder 17 caused by the application of air pressure to the pistons 18, 20 and 30*a*. Also, the movement of the rod 35*a* outwardly of the cylinder 17 causes the shoes of the shoe heads 12 and 14 to engage their respective wheels 8 and 10, in the same manner as the piston rod 35 acts, so that the tendency of the cylinder 17 to move in either direction is counter-balanced by the opposing forces of the brake shoes. Accordingly, as the air pressure is increased, the braking forces applied to each of the wheels by the brake shoe of the heads 11–14 become substantially equal. As the brake shoes wear, the lengths of the slack adjusters 57 and 60 change in a well-known manner, the length change being initiated by the triggers 59 and 61.

One of the advantages of the invention is that brake beams of the prior art in addition to a cylinder and piston assembly are not required. A cylinder and piston assembly normally is necessary in any type of braking apparatus, and the cylinder and piston assembly 16 takes the place of one of the conventional brake beams. The tube 63, the collars 64 and 65 and the end extension members 53 and 54 take the place of the other brake beam. Furthermore, conventional brake beams which transfer the braking forces from the cylinder and piston assembly and its associated levers to the brake shoe heads must be relatively strong and heavy since they are subjected to both compression and bending forces. It will be observed that in the apparatus of the invention, the highest braking forces are applied to the brake shoe heads 11–14 thereby eliminating the need for heavy and large components.

If the tube 63 is used as an air reservoir, as in the preferred embodiment, it is not necessary to have a separate, conventional air reservoir, the tube 63 serving two functions, namely, interconnection of the end extension members 53 and 54 and as an air reservoir.

With the invention, using multiple, oppositely acting pistons, it is possible to use one design for different capacity, e.g. 70 ton, 100 ton and 125 ton, trucks by changing the number of pistons and without changing the lever means which interconnects the piston rods with the slack adjusters and hence, the brake shoes, thereby drastically reducing manufacturing and service inventories.

For example, the industry requires that the braking forces be within the range of from 6% to 10% of the gross rail load. With a cylinder 17 with an outer diameter of 4⅞ in., as compared with a conventional prior art cylinder of about 10⅜ in., and six pistons of an effective area of 15.12 square inches each for the four pistons 18–20 nearest the piston rods 35 and 35*a* and 15.9 square inches for each of the two pistons 30 and 30*a* most remote from the piston rods 35 and 35*a*, 29,714 pounds of braking force would be provided at 50 p.s.i. air pressure which is 9.4% of the capacity of a 315,000 pound (125 ton) car.

If the braking apparatus of the invention is to be applied to a 100 ton (263,000 pound) car, only four pistons and cylinder partitions would be required to provide 19,977 pounds of braking force which is 7.6% of the 100 ton car capacity. In other words, to meet the requirements for the 100 ton car, only two pistons need be removed.

The same cylinder and piston assembly with four pistons can also be used for a 70 ton (220,000 pound) car because the braking force, 19,977 pounds, is 9.1% of the capacity of the 70 ton car.

Of course, the foregoing examples are only illustrative and show how the cylinder and piston assembly 16 can be used on a 125 ton car and with only the removal of two pistons can be used on both a 70 ton and a 100 ton car without modification. The number of pistons which can be used depends upon the required piston stroke and the distance between the side frames. The size of the cylinder 17 depends upon the space available at one side of the bolster 6. In all cases, there would be at least two pistons, but with the foregoing stroke, distance and space limitations in mind, the dimensions of the cylinder 17 and the pistons therein can be varied from the foregoing examples.

The positioning of the slack adjusters 57 and 60, in addition to providing direct measurement of shoe wear and not requiring holes in the bolster 6, has the advantage that, as compared to some prior art apparatus, the highest force on a system component is only on the components which actually produces the required car retarding force, i.e. the brake shoe heads.

A further advantage of the braking apparatus of the invention is that it is not necessary to secure any component of the apparatus to the truck 1. It will be observed that the only components other than the brake shoe heads 11–14, which engage a part of the truck 1 are the guide lugs 50 which have sliding engagement with the guide members 15 and the shoe heads 11–14 are carried by the end extension members 42, 43, 53 and 54.

Normally, it is necessary to permit the brakes to be set by a hand operable mechanism. As hereinafter described, the braking apparatus of the invention can include levers operable by a conventional hand brake mechanism to manually move the shoes of the shoe heads 11–14 into engagement with the wheels 7–10.

Figure 9:
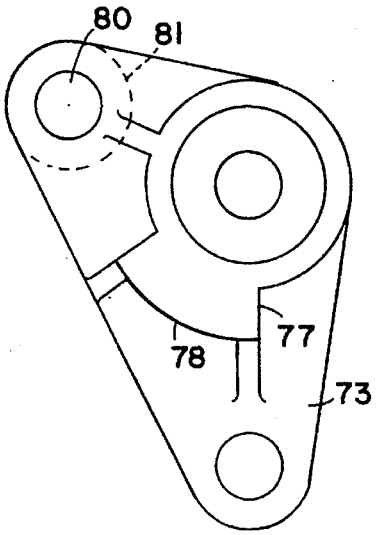
FIGS. 9 and 10 are, respectively, enlarged, bottom plan and side views of a lever base plate shown in FIGS. 1 and 2.
Figure 10:
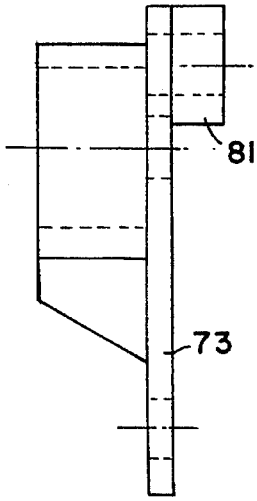
Figure 11:
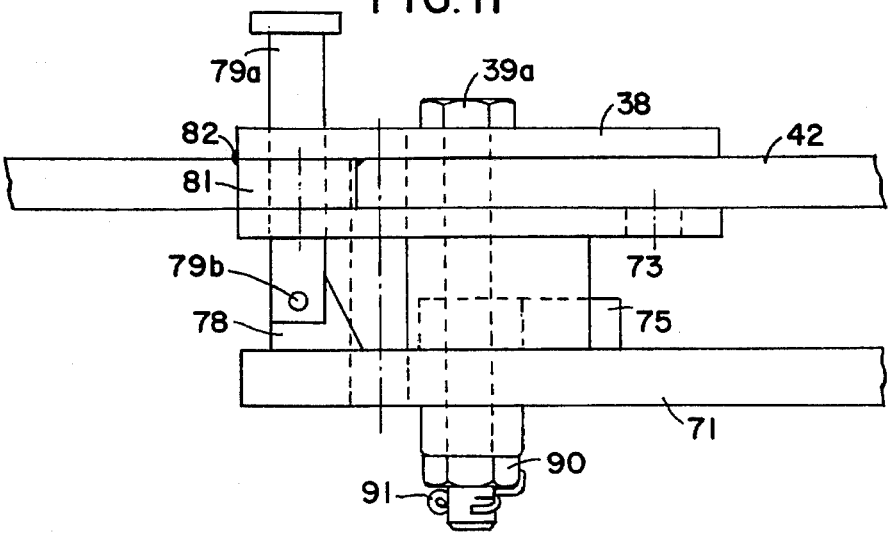
FIG. 11 is an enlarged side elevation view of portions of the apparatus shown in the preceding Figs.

The apparatus for setting the brakes by hand, which permits the brakes to be operated by the cylinder and piston assembly 16, is illustrated in FIGS. 1, 2, 3 and 8–11 and includes a pair of levers 70 and 71 interconnected by a return spring 72 and two lever base plates 73 (see FIG. 9) and 73*a*, one at each end of the cylinder and piston assembly 16. One of the lever base plates 73*a*, is intermediate the left hand lever 70 and the end extension member 43, and the other lever base plate, 73 is intermediate the right hand lever 71 and the end extension member 42 as illustrated in FIG. 11. The lever 71, its connection with the right hand base plate 73 and the end extension member 49 and its operation will be described in connection with the right hand lever 71, but the modifications of the right hand lever 71 required for use as the left hand lever 70 will be described hereinafter. However, except for the modifications, the function of the lever 70 is the same as the function of the lever 71.

The lever 71 has an end opening 74 for receiving one end of the return spring 72, has a projection 75 and an opening 76 for receiving a pivot pin 39 or a bolt 39*a* (FIG. 11) about which the lever 71 is pivotable. Due to the fact that the levers 70 and 71 pivot in opposite directions when the brakes are applied by hand, the lever 70 will differ from the lever 71 in that the opening 76 will be omitted and replaced by the opening 76*a*, displaced from the opening 76, and the projection 75 will be omitted and replaced by the projection 75*a*. The end extension member 42 is intermediate the lever base plate 73 and the lever 36, and with pivoting of the lever 71, the projection 75 is engageable with the face 77 of the projection 78 on the lever base plate 73 which, with further pivoting of the lever 70, will cause pivoting of the lever 38 which causes the shoes on the shoe heads 12 and 14 to engage their respective wheels 8 and 10.

Pivoting of the lever 38 with pivoting of the lever base plate 73 is caused by reason of the fact that a pin 79*a*, with a head and a hole 79*b* for receiving a collar pin, which pivotally connects the lever 38 to an end of the slack adjuster 60 extends through an opening, or pin hole, 80 of the plate 73. The opening 80 is surrounded by a boss 81 which, if necessary, can be welded to the lever 38, as at 82, so that 73 and 38 are secured to each other and aid in causing the lever 38 to pivot with the plate 73.

FIGS. 9, 10 and 11 illustrate the right hand lever base plate 73. The left hand lever base plate 73*a* is similar to the right hand lever base plate 73 except that, in an obvious manner, it is modified to be left handed and operable by the left hand lever 70.

When lever 71, and hence, the lever 70 are in their hand brake released positions, the levers 36 and 38, along with their base plates 73 and 73*a*, are permitted to pivot with movement of the piston rods 35 and 35*a* and apply the brakes as described hereinbefore.

As shown in FIG. 2, the levers 70 and 71, as shown in solid lines, are in their brake release positions, and when the brakes are applied by hand, the levers 70 and 71 move to the positions indicated by dot-dash lines 83 and 84. To equalize the pulling forces on the levers 70 and 71, the levers 70 and 71 can be connected to a cable or chain 85 which passes around a rotatable pulley 86. Of course, other force equalizing means can be used.

The pulley 86 is rotatable on an axle 87 which is connected to a manually operable hand brake mechanism (not shown) of a conventional type by a chain or cable 88 so that when the mechanism is operated to set the brakes, the pulley 86, and hence, the levers 70 and 71 move to the left, as viewed in FIG. 2, causing the brake shoes of the brake heads 11–14 to engage and apply braking forces to the respective wheels 7–10.

It has been previously indicated that the levers 36 and 38 can pivot around pins 37 and 39. Such pins 37 and 39 preferably are replaced by bolts, such as the bolt 39*a* shown in FIG. 11, which help to hold the parts between the bolt head 39 and the nut 90 in proper positions. Preferably, the bolt 39*a* is a shoulder bolt of a known type which has a shoulder at its threaded end engageable with the nut 90 and limiting the amount by which the nut 90 can be tightened, which, if overtightened would thereby prevent the parts between the head of the bolt 39*a* and the nut 90 from being easily pivotable. Relative rotation between the bolts 39*a* and the nut 90 is restricted by a cotter pin 91.

Although preferred embodiments of the present invention have been described and illustrated, it will be apparent to those skilled in the art that various modifications may be made without departing from the principles of the invention.

I claim:

1. Braking apparatus for a vehicle having a plurality of wheels and a plurality of brake shoes and for moving said brake shoes into engagement with said wheels, said braking apparatus comprising:

a cylinder and piston assembly comprising a fluid receiving cylinder and a plurality of pistons in said cylinder movable within said cylinder by fluid under pressure above atmospheric pressure supplied to said cylinder, said cylinder having at least one partition intermediate a pair of said pistons which is fixed in position with respect to said cylinder and which is in fluid-tight relation to said cylinder, means for introducing said fluid at a point intermediate said partition and said pair of said pistons, said fluid causing a piston at one side of said point to move in a first direction and a piston at the other side of said point to move in a second, opposite direction;

a first piston rod connected to said piston at one side of said point and a second piston rod connected to said piston at the other side of said point;

first interconnecting means, including first lever means, for interconnecting said first piston rod with a first one of said brake shoes and moving said first one of said brake shoes into engagement with a first one of said wheels; and second interconnecting means, including second lever means, for interconnecting said second piston rod with a second one of said brake shoes and moving said second one of said brake shoes into engagement with a second one of said wheels.

2. Braking apparatus as set forth in claim 1 wherein said vehicle is a railway car with at least one truck for supporting said vehicle, said truck having a bolster supported by said plurality of wheels and wherein said cylinder and piston assembly is mounted for movement with respect to said bolster.

3. Braking apparatus as set forth in claim 2, wherein said first interconnecting means and said second interconnecting means are mounted for movement with said cylinder and piston assembly and with respect to said bolster.

4. Braking apparatus for a railway vehicle having a truck with a bolster supported by four wheels, said braking apparatus comprising:

a cylinder and piston assembly comprising a fluid receiving cylinder and at least two pairs of pistons in said cylinder movable within said cylinder by fluid under pressure above atmospheric pressure supplied to said cylinder at a point on said cylinder intermediate each pair of said pistons and at points intermediate said pistons, said fluid causing one of said two pairs of pistons at one side of said point to move in a first direction and the other of said two pairs of pistons at the other side of said point to move in a second, opposite direction;

a first piston rod connected to said one of said two pairs of pistons at one side of said point and a second piston rod connected to said other of said two pairs of pistons at the other side of said point;

four brake shoe heads, each with a brake shoe adjacent and engageable, respectively, with one of said four wheels;

a first end extension member connected to one end of said cylinder and connected to a first one of said brake shoe heads;

a second end extension member connected to the opposite end of said cylinder and connected to a second one of said brake shoe heads;

a first lever pivotally connected to said first piston rod and pivotable on a pivot axis on said first end extension member;

a second lever pivotally connected to said second piston rod and pivotable on a pivot axis on said second end extension member;

first interconnecting means interconnecting said first lever at a point spaced from its pivot axis on said first end extension member with a third one of said brake shoe heads;

second interconnecting means interconnecting said second lever at a point spaced from its pivot axis on said second end extension member with a fourth one of said brake shoe heads; and third interconnecting means interconnecting and supporting said third one of said brake shoe heads and said fourth one of said brake shoe heads whereby the supply of fluid under pressure above atmospheric pressure to said point and said points on said cylinder moves each said piston rod outwardly of said cylinder in opposite directions and moves each said brake shoe head and its brake shoe toward the wheel adjacent thereto and applies braking force to the adjacent wheel.

5. Braking apparatus as set forth in claim 4 wherein each of said first interconnecting means and said second interconnecting means comprises a brake slack adjuster.

6. Braking apparatus as set forth in claim 5 wherein the brake slack adjuster of said first interconnecting means is connected at one end to said first lever and at the opposite end thereof to said third one of said brake shoe heads and the brake slack adjuster of said second interconnecting means is connected at one end to said second lever and at the opposite end thereof to said fourth one of said brake shoe heads.

7. Braking apparatus as set forth in claim 4 wherein said third interconnecting means comprises a tube, a third end extension member connected to one end of said tube and to said third one of said brake shoe heads and a fourth end extension member connected to the other end of said tube and to said fourth one of said brake shoe heads.

8. Braking apparatus as set forth in claim 7 wherein said tube can receive and hold a fluid under pressure above atmospheric pressure and further comprising a fluid valve and fluid transfer means interconnecting said tube and said point and said points on said cylinder for supplying fluid under pressure from said tube to said cylinder.

9. Braking apparatus as set forth in claim 4 further comprising a pivotable third lever and a pivotable fourth lever, each manually pivotable, and first lever base plate means connected to said first lever for pivoting said first lever and second lever base plate means connected to said second lever for pivoting said second lever, said third lever and said first lever base plate means having interengageable projections which permit said first lever to pivot without pivoting of said third lever but which cause said first lever base plate means to pivot when said third lever is pivoted and said fourth lever and and said second lever base plate means having interengageable projections which permit said second lever to pivot without pivoting of said fourth lever but which cause said second lever base plate means to pivot when said fourth lever is pivoted.

10. Braking apparatus as set forth in claim 9 further comprising pulling means connected to both said third lever and said fourth lever for connecting said third lever and said fourth lever to a hand brake mechanism.

11. Braking apparatus as set forth in claim 10 wherein said pulling means comprises force equalizing means for equalizing the pulling forces applied to said third lever and said fourth lever.

12. Braking apparatus for a vehicle having at least four wheels and at least four brake shoes respectively engageable with said four wheels and for moving said brake shoes into engagement with said wheels, said braking apparatus comprising:

a cylinder and piston assembly comprising a fluid receiving cylinder and a plurality of pistons in said cylinder movable within said cylinder by fluid under pressure above atmospheric pressure supplied to said cylinder at a point intermediate a pair of said pistons, said fluid causing a piston at one side of said point to move in a first direction and a piston at the other side of said point to move in a second, opposite direction;

a first piston rod connected to said piston at one side of said point and a second piston rod connected to said piston at the other side of said point;

first interconnecting means, including first lever means, for interconnecting said first piston rod with a first one of said brake shoes and moving said first one of said brake shoes into engagement with a first one of said wheels;

second interconnecting means, including second lever means, for interconnecting said second piston rod with a second one of said brake shoes and moving said second one of said brake shoes into engagement with a second one of said wheels;

third interconnecting means, including a first slack adjuster, interconnecting said first lever means and a third one of said brake shoes for moving said third one of said brake shoes into engagement with a third one of said wheels;

fourth interconnecting means, including a second slack adjuster, interconnecting said second lever means and a fourth one of said brake shoes for moving said fourth one of said brake shoes into engagement with a fourth one of said wheels; and fifth interconnecting means interconnecting said third one of said brake shoes and said fourth one of said brake shoes for supporting said third one and said fourth one of said brake shoes as said third one and fourth one of said brake shoes move, respectively, toward said third wheel and said fourth wheel with movement of said first slack adjuster and said second slack adjuster.

13. Braking apparatus as set forth in claim 5 wherein said fifth interconnecting means comprises a fluid tight cylinder for receiving said fluid under pressure and further comprising fluid transfer means interconnecting said fluid tight cylinder with said point of said cylinder and piston assembly for supplying fluid from said fluid tight cylinder to said cylinder and piston assembly at said point.

14. Braking apparatus for a railway car with at least one truck for supporting said vehicle, said truck having a bolster supported by four wheels, a first one of said wheels being at a first end and at a first side of said bolster, a second one of said wheels being at the second, opposite end and at said first side of said bolster, a third one of said wheels being at said first end and at a second, opposite side of said bolster and a fourth one of said wheels being at said second end and at said second side of said bolster, said braking apparatus comprising:

a cylinder and piston assembly disposed at said first side of said bolster intermediate said first end and said second end of said bolster and comprising a fluid receiving cylinder and a plurality of pistons in said cylinder movable within said cylinder by fluid under pressure above atmospheric pressure supplied to said cylinder at a point intermediate a pair of said pistons, said fluid causing a piston at one said of said point to move in a first direction and a piston at the other side of said point to move in a second, opposite direction;

a first piston rod connected to said piston at one side of said point and being movable from said cylinder toward said first end of said bolster and said second piston rod and a second piston rod connected to said piston at the other side of said point and being movable from said cylinder toward said second end of said bolster;

first interconnecting means, including first lever means, for interconnecting said first piston rod with a first one of said brake shoes and moving said first one of said brake shoes into engagement with a first one of said wheels; and second interconnecting means, including second lever means, for interconnecting said second piston rod with a second one of said brake shoes and moving said second one of said brake shoes into engagement with a second one of said wheels.

15. Braking apparatus as set forth in claim 14 wherein said first lever means is at said first end and at said first side of said bolster, and said second lever means is at said second end and at said first side of said bolster and further comprising:

a third brake shoe at said first end and at said second side of said bolster and movable into engagement with said third wheel;

a fourth brake shoe at said second end and at said second side of said bolster and movable into engagement with said fourth wheel;

third interconnecting means, including a first slack adjuster, for interconnecting said first lever means and said third brake shoe for moving said third brake shoe into engagement with said third wheel;

fourth interconnecting means, including a second slack adjuster, for interconnecting said second lever means to said fourth brake shoe and for moving said fourth brake shoe into engagement with said fourth wheel; and fifth interconnecting means at said second side of said bolster interconnecting said third brake shoe and said fourth brake shoe for supporting said third brake shoe and said fourth brake shoe as said third brake shoe and said fourth brake shoe move, respectively, toward said third wheel and said fourth wheel with movement of said first slack adjuster and said second slack adjuster.

16. Braking apparatus as set forth in claim 15 wherein said fifth interconnecting means comprises a fluid tight cylinder for receiving said fluid under pressure and further comprising fluid transfer means interconnecting said fluid tight cylinder with said point of said cylinder and piston assembly for supplying fluid from said fluid tight cylinder to said cylinder and piston assembly at said point.

17. Braking apparatus as set forth in claim 15 wherein said cylinder and piston assembly is mounted for movement with respect to said bolster.

18. Braking apparatus as set forth in claim 17 wherein each of said first, second, third, fourth and fifth interconnecting means is movable with respect to said bolster.

19. Braking apparatus for a vehicle having a plurality of wheels and a plurality of brake shoes and for moving said brake shoes into engagement with said wheels, said braking apparatus comprising:

a cylinder and piston assembly comprising a fluid receiving cylinder and a plurality of pistons in said cylinder movable within said cylinder by fluid under pressure above atmospheric pressure supplied to said cylinder at a point intermediate a pair of said pistons, said fluid causing a piston at one side of said point to move in a first direction and a piston at the other side of said point to move in a second, opposite direction;

a first piston rod connected to said piston at one side of said point and a second piston rod connected to said piston at the other side of said point;

first interconnecting means, including first lever means, for interconnecting said first piston rod with a first one of said brake shoes and moving said first one of said brake shoes into engagement with a first one of said wheels;

second interconnecting means, including second lever means, for interconnecting said second piston rod with a second one of said brake shoes and moving said second one of said brake shoes into engagement with a second one of said wheels;

a pivotable third lever means and a pivotable fourth lever means, each manually pivotable, and first lever base plate means connected to said first lever means and second lever means base plate connected to said second lever means for pivoting said second lever means, said third lever means and said first lever base plate means having interengageable projections which permit said first lever means to pivot without pivoting of said third lever means but which cause said first lever base plate means to pivot when said third lever means is pivoted and said fourth lever means and said second lever base plate means having interengageable projections which permit said second lever means to pivot without pivoting of said fourth lever means but which cause said second lever base plate means to pivot when said fourth lever means is pivoted.

20. Braking apparatus as set forth in claim 19 further comprising pulling means connected to both said third lever and said fourth lever for connecting said third lever and said fourth to a hand brake mechanism.

21. Braking apparatus as set forth in claim 20 wherein said pulling means comprises force equalizing means for equalizing the pulling forces applied to said third lever and said fourth lever.

* * * * *

UNITED STATES PATENT AND TRADEMARK OFFICE

CERTIFICATE OF CORRECTION

PATENT NO. : 5,507,368
DATED : April 16, 1996
INVENTOR(S) : Barefoot

It is certified that error appears in the above-indentified patent and that said Letters Patent is hereby corrected as shown below:

Col. 11, line 45, change "5" to --12--.

Signed and Sealed this

First Day of October, 1996

Bruce Lehman

*Attest:*

BRUCE LEHMAN

*Attesting Officer*

*Commissioner of Patents and Trademarks*